US006135444A

United States Patent [19]

Padget

[11] Patent Number: 6,135,444

[45] Date of Patent: Oct. 24, 2000

[54] AUTOMATIC SHEET FEEDING MECHANISM

[75] Inventor: Martin Jay Padget, San Diego, Calif.

[73] Assignee: Hewlett-Packard Company, Palo Alto, Calif.

[21] Appl. No.: 09/428,132

[22] Filed: Oct. 26, 1999

Related U.S. Application Data

[62] Division of application No. 09/211,088, Dec. 15, 1998.

[51] Int. Cl.[7] ..... B65H 3/06

[52] U.S. Cl. ..... 271/121; 271/118; 271/119; 271/120; 271/902

[58] Field of Search ..... 271/118, 119, 271/120, 121, 902

[56] References Cited

U.S. PATENT DOCUMENTS

| | | | |
|---|---|---|---|
| 763,159 | 6/1904 | Cross | 271/120 |
| 3,571,691 | 3/1971 | Heinricy | 271/23 |
| 3,630,516 | 12/1971 | Hong | 271/36 |
| 3,970,297 | 7/1976 | Blowsky | 270/58 |
| 4,043,549 | 8/1977 | Rinehart | 271/118 |
| 4,126,305 | 11/1978 | Colgazier et al. | 271/120 |
| 4,175,741 | 11/1979 | Colglazier et al. | 271/3.1 |
| 4,305,577 | 12/1981 | Clay et al. | 271/119 |
| 4,306,713 | 12/1981 | Avritt et al. | 271/37 |
| 4,381,860 | 5/1983 | Silverberg | 271/10 |
| 4,463,943 | 8/1984 | Deconinck | 271/21 |
| 4,475,733 | 10/1984 | Benson | 271/120 |
| 4,496,144 | 1/1985 | Perun et al. | 271/114 |
| 4,515,357 | 5/1985 | Hamlin | 271/120 |
| 4,640,504 | 2/1987 | Garavuso et al. | 271/113 |
| 4,750,726 | 6/1988 | Looney | 271/10 |
| 4,900,006 | 2/1990 | Mandel | 271/178 |
| 5,120,042 | 6/1992 | Goto et al. | 271/117 |
| 5,226,743 | 7/1993 | Jackson et al. | 400/625 |
| 5,372,359 | 12/1994 | Miura et al. | 271/119 |
| 5,485,991 | 1/1996 | Hirano et al. | 271/121 |
| 5,558,319 | 9/1996 | Crowley et al. | 270/58.31 |
| 5,564,688 | 10/1996 | Samii | 271/109 |
| 5,655,761 | 8/1997 | Sanchez | 271/4.09 |
| 5,725,208 | 3/1998 | Miyauchi | 271/10.09 |
| 5,727,782 | 3/1998 | Okada | 271/121 |
| 5,758,981 | 6/1998 | Lesniak et al. | 400/625 |
| 5,954,328 | 9/1999 | Hatanaka | 271/119 |

FOREIGN PATENT DOCUMENTS

| | | | |
|---|---|---|---|
| 2 241 493 | 9/1991 | United Kingdom | B65H 3/02 |

*Primary Examiner*—Christopher P. Ellis
*Assistant Examiner*—Michael E. Butler

[57] ABSTRACT

A sheet feeding mechanism including a pick apparatus for selectively moving a sheet of media from a stack. A kicker is disclosed in several embodiments and serves to retain media on the stack. In a first embodiment, a cam is coupled to the pick apparatus for deflecting the kicker from the first position at which it retains media on the stack to a second position at which paper is allowed to move through the mechanism. In a particular implementation of the first illustrative embodiment, the mechanism includes a frame and a shaft mounted on the frame for rotational movement relative thereto. The pick apparatus includes a pick tire mounted on the shaft and adapted to rotate therewith. The kicker is mounted on the frame for retaining media on the stack in a first position. The cam is adapted to deflect the kicker during a first portion of a rotational cycle and to release the kicker when the cam is in a second rotational position. In a second embodiment, the cam is contoured to provide a protruded edge which engages the kicker when the cam is counter-rotated. This forces the kicker to push media remaining on a separation roll back onto the stack and is particularly well suited for printers utilizing inclined media trays. In a third embodiment, the kicker is mounted on a shaft along with a separation roll. In a specific implementation of this embodiment, the kicker is a flexible strip of plastic that flexes as it engages the stack when the shaft is rotated and after it has rotated around, pushes media remaining on the separation roll back onto the stack. Finally, a fourth embodiment is disclosed by which the kickers are implemented with a plurality of small gravity actuated kickers mounted between two pick tires. The kickers are adapted to fall out of the way when the pick tires are rotating in a first direction and to fall into position to push media back onto the stack when the pick tires are counter-rotated.

4 Claims, 14 Drawing Sheets

10
12
16
130
27
38
37
35
38
36
26
20
22
24
66
15
32
34
30
18
14
40

FIG. 5a
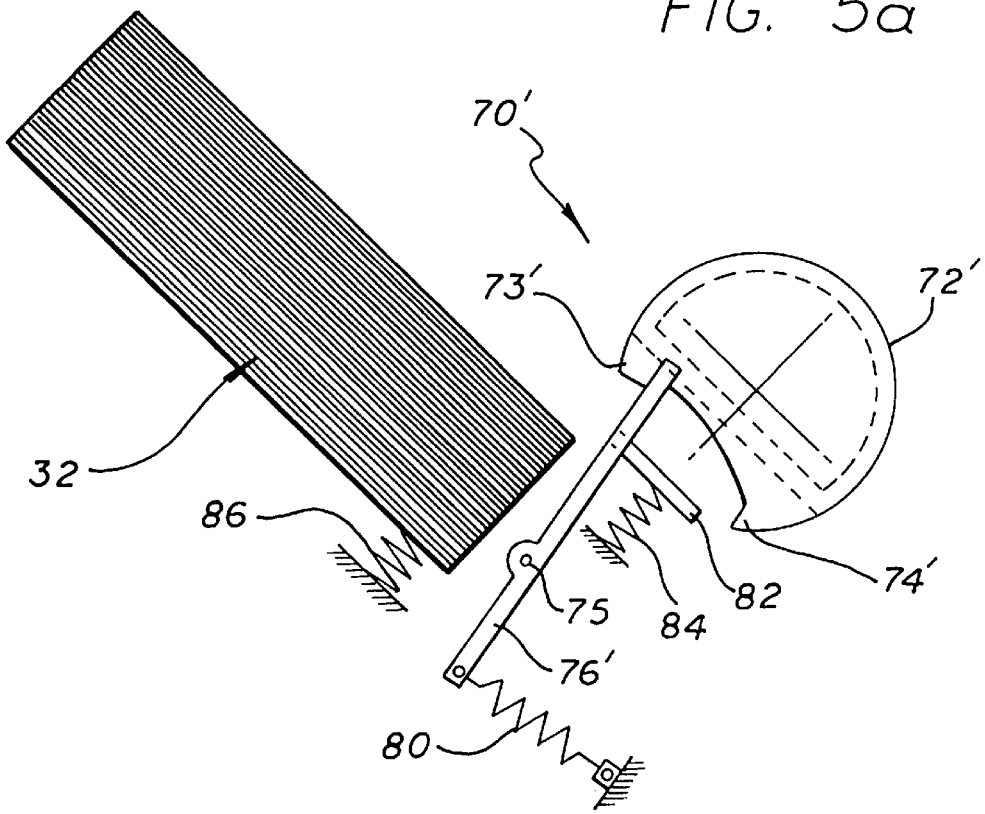
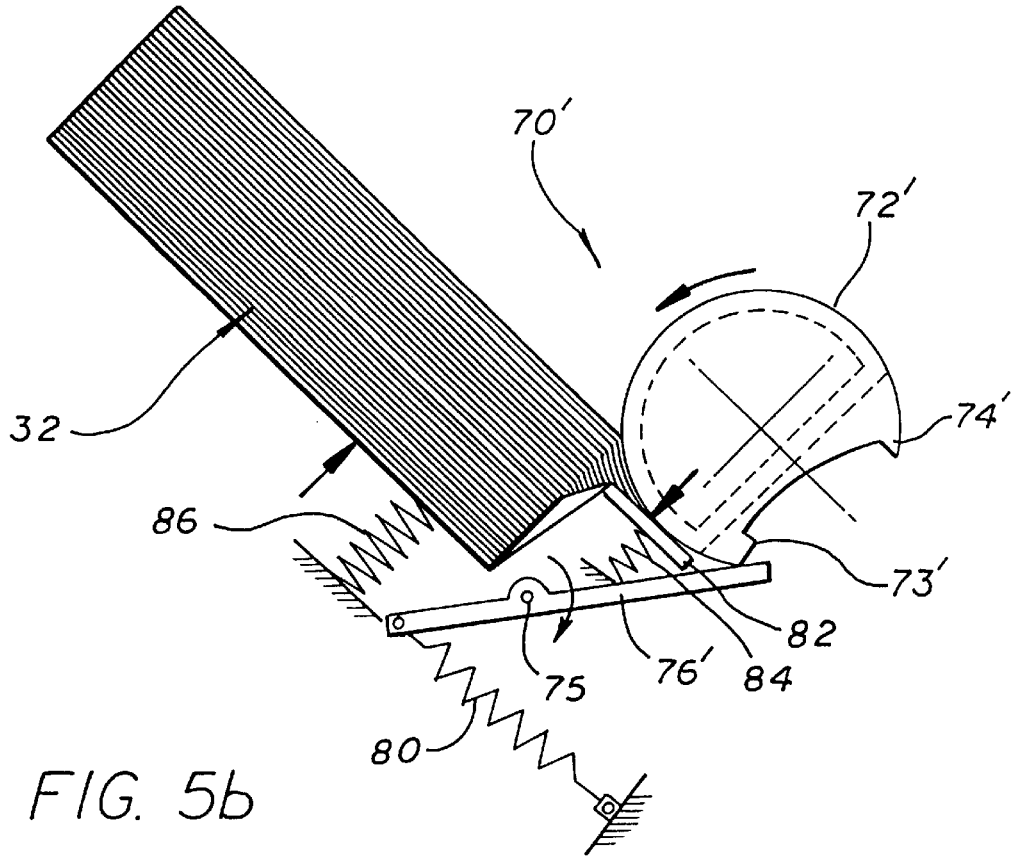
FIG. 5b

FIG. 5c
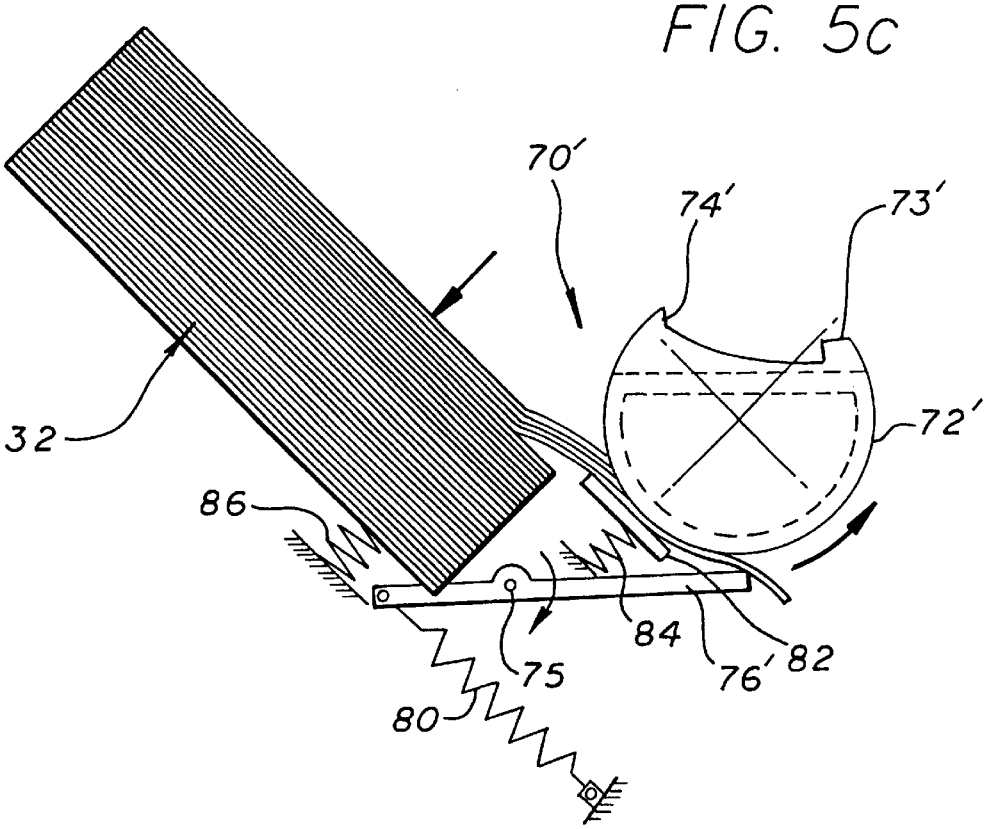
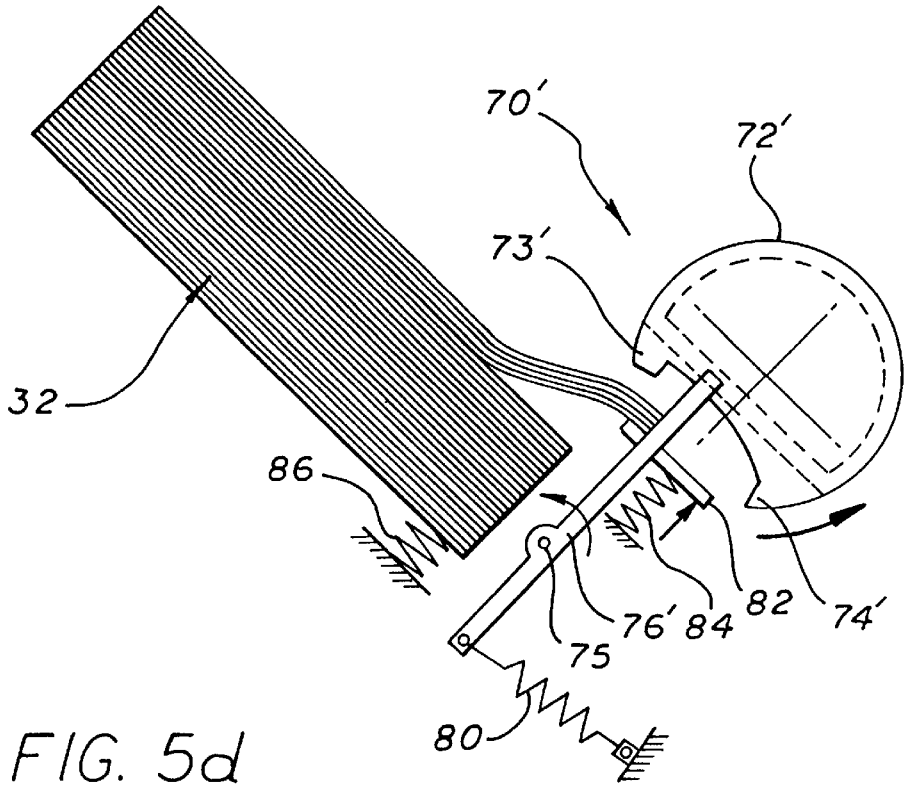
FIG. 5d

FIG. 5e
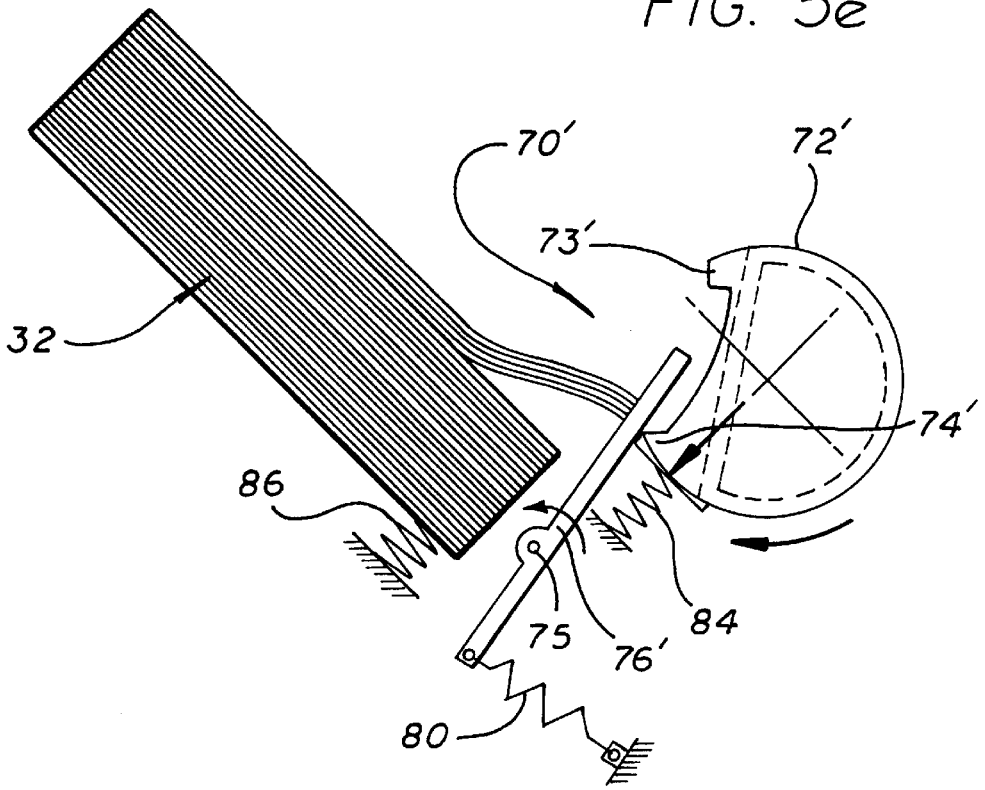
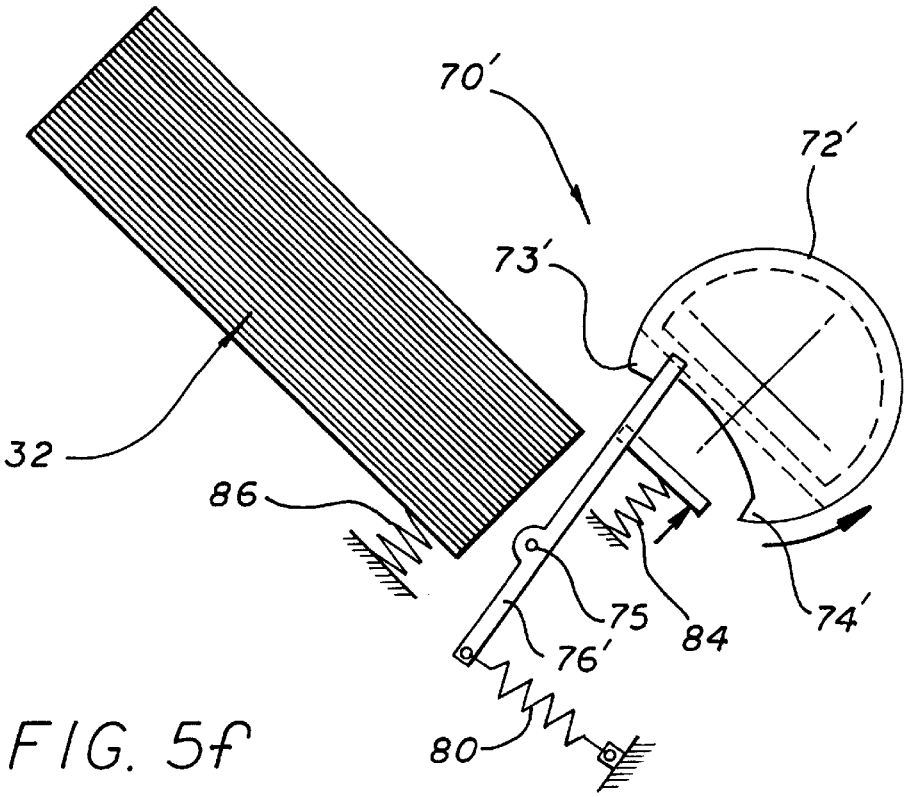
FIG. 5f

AUTOMATIC SHEET FEEDING MECHANISM

CROSS REFERENCE TO RELATED APPLICATION(S)

This is a divisional of copending application Ser. No. 09/211,088 filed on Dec. 15, 1998.

BACKGROUND OF THE INVENTION

1. Field of the Invention

The present invention relates to hard copy media control apparatus. More specifically, the present invention relates to method and apparatus for control of paper in a cut-sheet paper feeding mechanisms for use with printers, plotters, copiers, facsimile machines and the like.

2. Description of the Related Art

Paper feed mechanisms for hard copy control apparatus are well known in the art. In automatic cut sheet printers, a stack of paper is automatically fed to a printer, plotter, copier, facsimile machine, or other apparatus typically using a roller assembly or other mechanism. An important function of the feed mechanism is to control the parallelism between the top edge of the sheet of paper and the first line of print contained thereon, i.e., the amount of skew between the paper and the print. Even a small amount of skew between the paper and print will cause the printing to appear crooked. Larger amounts of skew may cause buckling of the paper, resulting in uneven print quality or jamming of the paper within the printer. The skew is generally induced when the paper is loaded into and/or picked from a stack of paper in a supply tray. Accordingly, it is desirable to minimize the amount of skew between the paper and the printing assembly once the paper has been picked and before it is printed on.

Prior art printing devices use a variety of techniques and apparatus to minimize skew. Some minimize skew by forcing a sheet of paper into a pair of stalled rollers, creating a buckle in the paper and forcing the leading edge of the paper to be parallel with the roller pair. The rollers are then activated to advance the paper into the print zone. Such a technique requires some type of clutching mechanism to stall the rollers long enough to allow the paper to be fed into the nip between the rollers. Further, this technique requires accurate control of the paper while it is buckling, as the buckle must be large enough to correct the skew, yet small enough that the paper does not flip out of the nip between the stalled rollers. Other prior art devices use tapered rollers which direct the sheet of paper against a reference wall, forcing it into alignment therewith and eliminating any skew before printing. This technique requires a large, flat surface in the area of the roller assembly and is relatively slow. Still other devices have no skew correction mechanism at all, relying entirely on the accurate feeding of paper into the roller assembly.

In addition to minimizing skew, the feed mechanism must maintain accurate control of each sheet, from the time it is picked from the stack until it is ejected from the apparatus. The paper feed mechanisms of typical prior art printers, plotters copiers, facsimile machines and the like use separate motors and gear arrangements to pick the paper from a stack, deliver the paper to a printing assembly, line feed the paper and eject the paper once printed. Such feed mechanisms often encumber the carriage drive motor and have complex timing schemes requiring triggering devices, such as solenoids. The large number of motors and other electrical components increases the cost of the apparatus. Further, complex feed mechanisms increase the amount of time necessary to pass a page through the apparatus, as well as the chances of paper jams and skew errors.

The need in the art for a sheet feeding mechanism having a minimal number of control devices was addressed to some extent by U.S. Pat. No. 5,226,743 issued Jul. 13, 1993 to Jackson et al. and entitled METHOD AND APPARATUS FOR PAPER CONTROL IN A PRINTER, the teachings of which have been incorporated herein by reference. This reference discloses and claims an apparatus for control of a sheet of paper in a printer mechanism including a single motor drive mechanism, a frame, a platen, a roller assembly for advancing sheet of paper over the plates, and a kicker element for selectively contacting only an edge of a sheet of paper and for urging the sheet of paper in a forward direction once it is disengaged from the roller assembly.

Notwithstanding the benefits associated with the design set forth in the above-referenced patent, a need remains in the art for further improvements in sheet feed mechanisms which afford reliable, accurate control of paper through an apparatus with high throughput at low cost. This is particularly true with respect to the role of the kicker.

Kickers are used to assist in the movement of paper in sheet feeding mechanisms. For example, a kicker may be used to assist in the movement of a printed page into a receiving tray as disclosed in the above-identified Jackson patent. In the alternative, kickers may be used to reset stacks of paper in a sheet feeder during a printing operation so that the printing of each sheet starts from a known initial state.

Currently, many sheet feeding mechanisms are known in the art. Typically, sheet feeding is accomplished using a roller on top of the paper and a friction pad on the bottom. In this application, the kicker assists in the movement of paper out of the nip area between the roller and the pad to prevent multi-feeds.

Unfortunately, conventional kicker mechanisms require many parts and are therefore costly and require a considerable amount of space. Hence, a need remains in the art for an inexpensive yet effective kicker mechanism for the next generation of hard copy apparatus.

SUMMARY OF THE INVENTION

The need in the art is addressed by the sheet feeding mechanism of the present invention. Generally, the inventive mechanism includes a pick apparatus for selectively moving a sheet of media from a stack. A kicker is disclosed in several embodiments which serves to retain media on the stack. In a first embodiment, a cam is coupled to the pick apparatus for deflecting the kicker from the first position at which it retains media on the stack to a second position at which paper is allowed to move through the mechanism. In a particular implementation of the first illustrative embodiment, the mechanism includes a frame and a shaft mounted on the frame for rotational movement relative thereto. The pick apparatus includes a pick tire mounted on the shaft and adapted to rotate therewith. The kicker is mounted on the frame for retaining media on the stack in a first position. The cam is adapted to deflect the kicker during a first portion of a rotational cycle and to release the kicker when the cam is in a second rotational position.

In a second embodiment, the cam is contoured to provide a protruded edge which engages the kicker when the cam is counter-rotated. This forces the kicker to push media remaining on a separation roll back onto the stack and is particularly well suited for printers utilizing inclined media trays.

In a third embodiment, the kicker is mounted on a shaft along with a separation roll. In a specific implementation of this embodiment, the kicker is a flexible strip of plastic that flexes as it engages the stack when the shaft is rotated. After the kicker has rotated around the shaft, it pushes media remaining on the separation roll back onto the stack. A particularly novel aspect of this implementation is the use of the media as a separation spring between pick tires mounted on a first shaft and the separation roll mounted on a second shaft. The separation spring effect facilitates the separation of individual sheets of media from others in the stack.

Finally, a fourth embodiment is disclosed having a plurality of small gravity actuated kickers mounted between two pick tires. The kickers are adapted to fall out of the way when the pick tires are rotating in a first direction and to fall into position to push media back onto the stack when the pick tires are counter-rotated.

BRIEF DESCRIPTION OF THE DRAWINGS

FIGS. 5*a*–5*f* provide simplified side views of the second illustrative embodiment of the inventive kicker mechanism in various stages of the operational cycle thereof.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
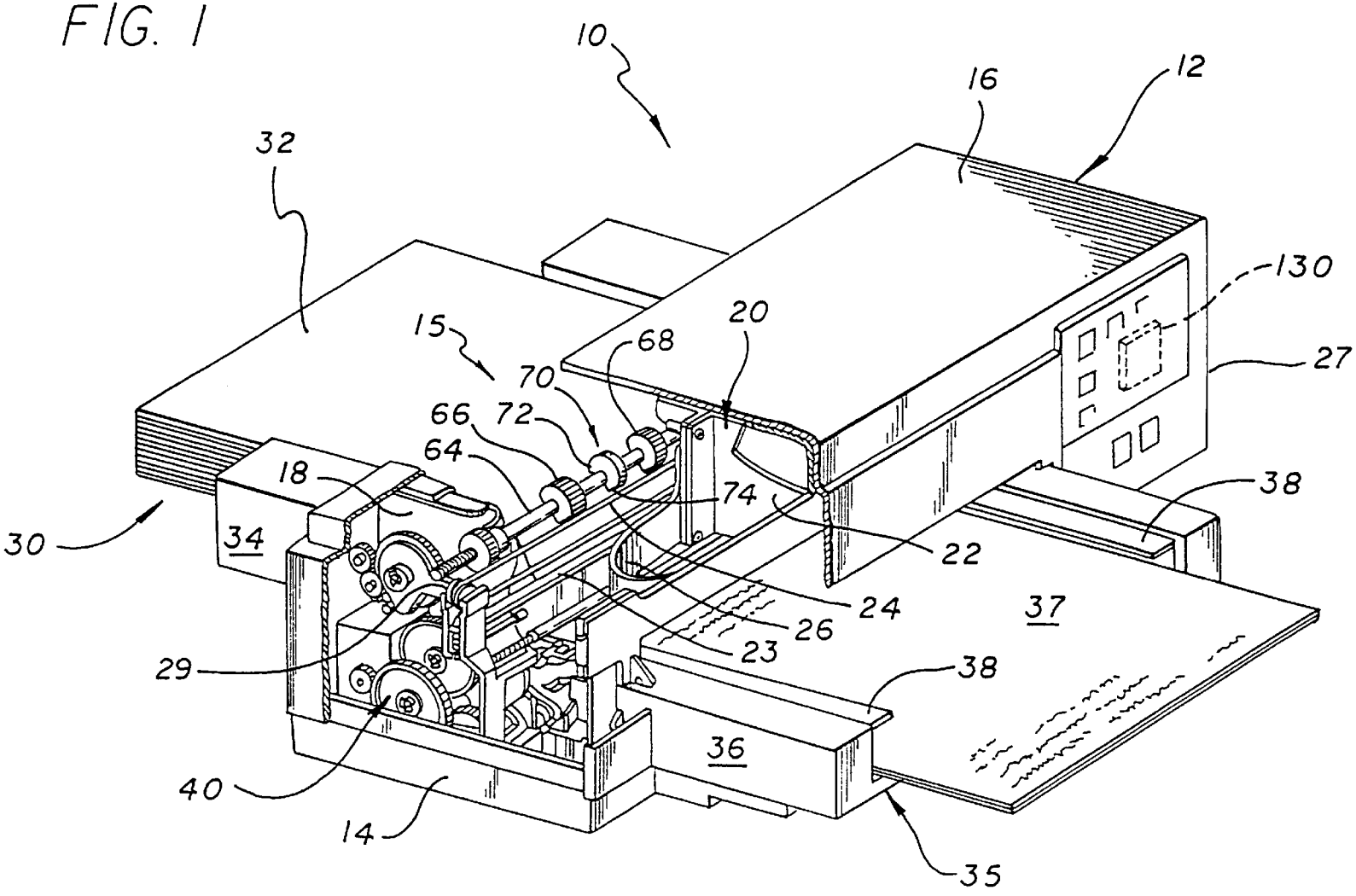
FIG. 1 is a perspective view of a printer incorporating a first illustrative embodiment of the sheet feeding mechanism of the present invention with the housing thereof partially removed.

FIG. 1 is a perspective view of a printer incorporating a first illustrative embodiment of the sheet feeding mechanism of the present invention with the housing thereof partially removed. Those skilled in the art will appreciate that the present teachings may be used with printers, plotters, copiers, facsimile machines and other hard copy media control apparatus without departing from the scope thereof. As shown in FIG. 1, the printer 10 includes a housing assembly 12 which contains a paper control apparatus 15 and a printing assembly 20. The housing assembly 12 is comprised of a substantially rectangular base 14 having a pair of frame walls 18 projecting upwardly therefrom. A support (not shown) having a substantially L-shaped cross-sectional profile and a lip, extends between frame walls 18 and supports a supply assembly 30. The components of the paper control apparatus 15 and the printing assembly 20 are secured to the base 14, walls 18 and the support. A cover 16 is removably mounted to the base 14 to allow access to the interior thereof. A tray 34 containing a supply of paper, or other print medium, in a stack 32 is removably mounted within the printer 10. A receiving tray 36 is secured to the base 14. The receiving tray 36 projects outwardly from an aperture in front of the cover 16 for receiving printed sheets of paper. Each sheet of paper is moved by a paper control apparatus 15 through a printing zone where the print assembly 20 deposits ink on the paper as it advances toward a receiving tray 36.

As is well known in the art, and described in detail in the above-referenced U.S. Patent to Jackson et a., the teachings of which are incorporated herein by reference, the print assembly 20 includes a printhead carriage 22 which travels back and forth on a carriage rod 23 through the printing zone. The printhead carriage 22 moves bi-directionally by means of a drive wire 24 coupled to a carriage motor by drive wire spools 29, in a manner well known to those skilled in the art. The printhead carriage 22 includes one or more print cartridges (not shown) having printheads at the bottom thereof. The printhead cartridges are connected by a flexible electrical interconnect strip 26 to a microprocessor 130, shown in phantom in FIG. 1. The microprocessor 130 controls a carriage motor (not shown). A control panel 27 is electrically coupled with the microprocessor 130 for selection of various options relating to the operation of a print assembly 20. Such control operations are provided by presently available microprocessors as is well known in the art. The structure and operation of the print assembly 20 forms no part of the present invention and, accordingly, will not be described in further detail hereinafter. Further, although the microprocessor 130 is shown in the proximity of the control panel 27 in FIG. 1, it will be obvious to those reasonably skilled in the art that the microprocessor 130 may be positioned at other locations within the housing 12 provided that the necessary electrical connections may be made to the other elements of the printer 10.

In accordance with the present teachings, the paper control apparatus 15 includes first and second pick tires 66 and 68 for picking a single sheet of paper from the stack 32 and a kicker mechanism 70 for resetting the stack 32 thereafter to an initialized state. The kicker mechanism 70 is disclosed with respect to several illustrative embodiments. Those skilled in the art will appreciate that additional embodiments incorporating the teachings of the present invention may be realized without departing from the scope thereof.

Figure 2A:
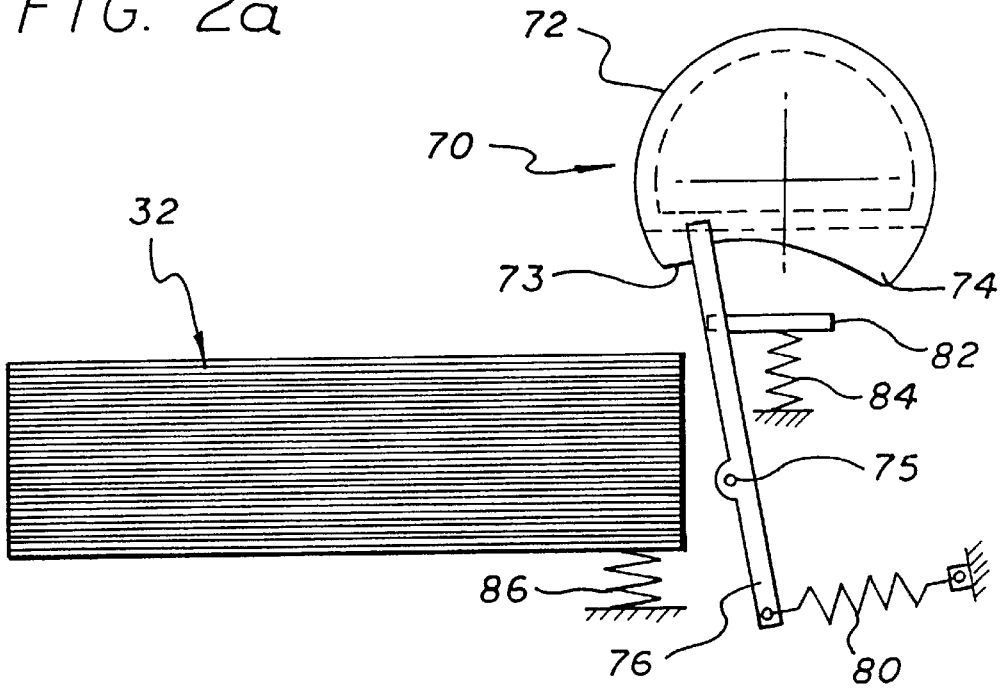
FIGS. 2*a*–2*d* provide simplified side views of the first illustrative embodiment of the inventive kicker mechanism in various stages of the operational cycle thereof.
Figure 2B:
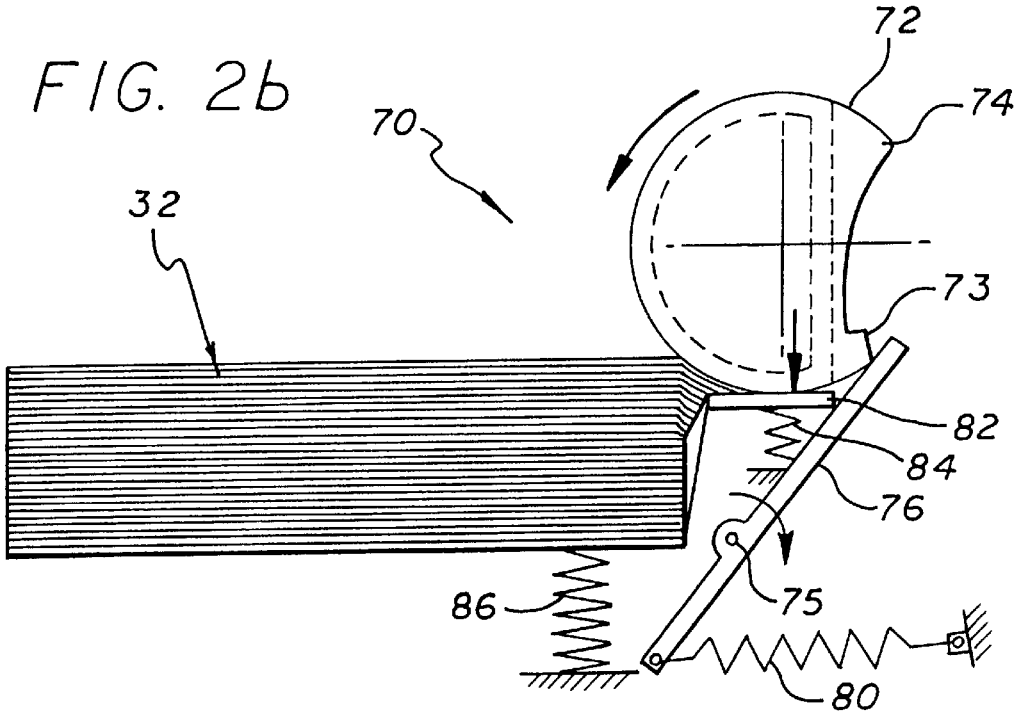
Figure 2C:
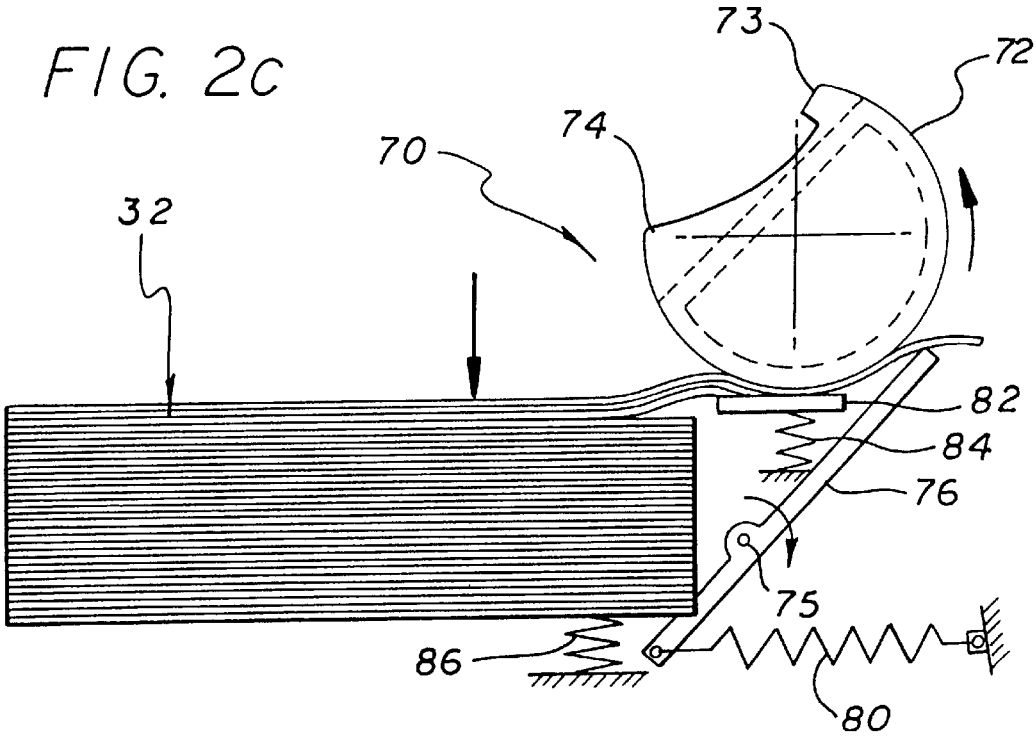
Figure 2D:
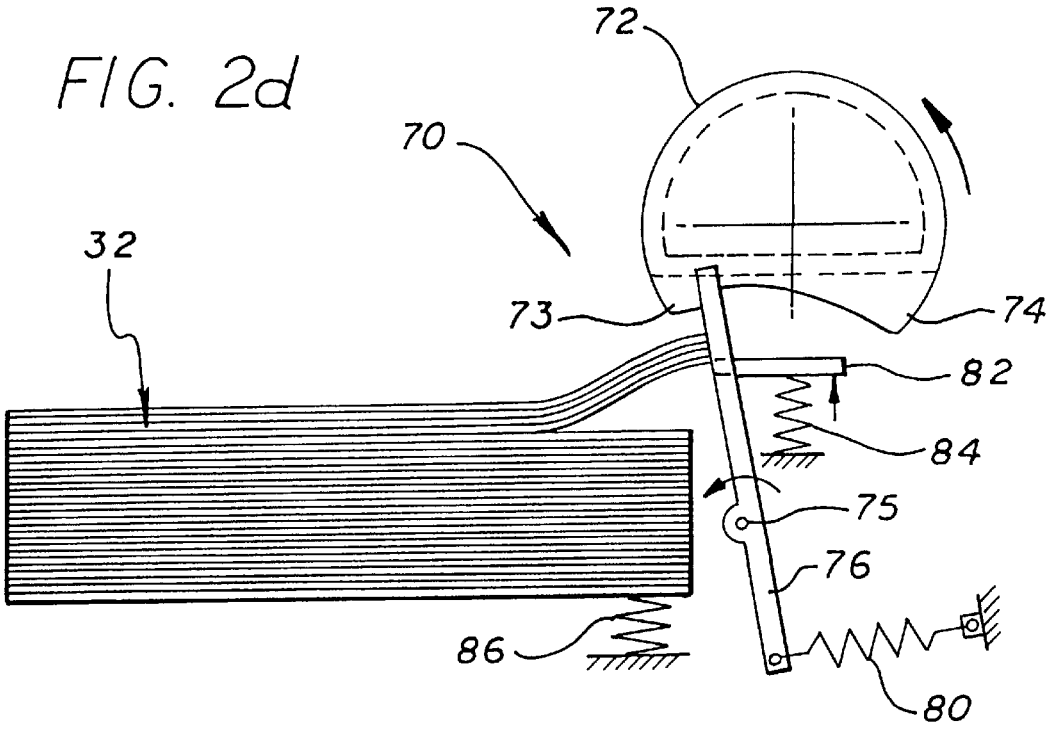
Figure 3:
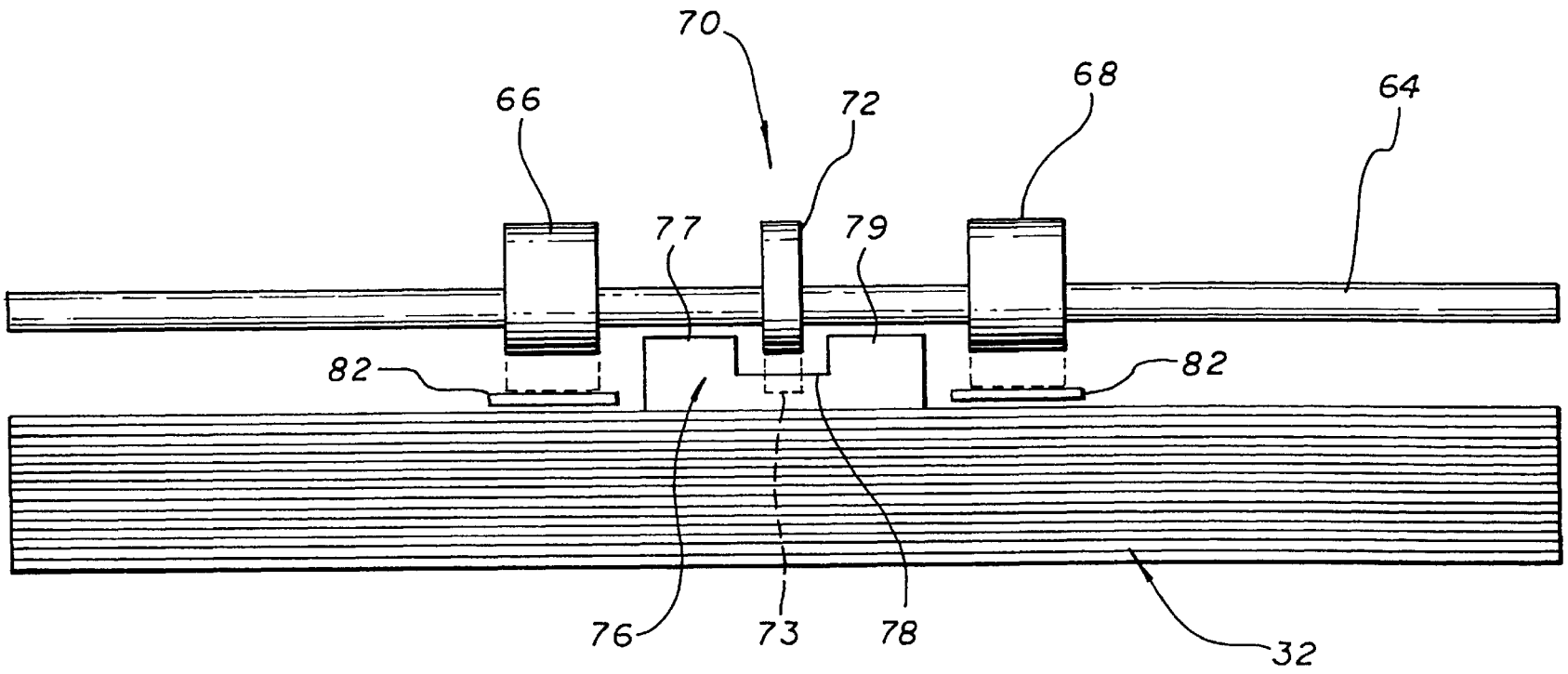
FIG. 3 is a simplified frontal view of the first illustrative embodiment of the kicker mechanism incorporating the teachings of the present invention.

The first illustrative embodiment of a kicker mechanism utilizing the teachings of the present invention is depicted in FIGS. 1, 2*a*–2*d*, and 3. FIGS. 2*a*–2*d* provide simplified side views of the first illustrative embodiment of the inventive kicker mechanism 70 in various stages of the operational cycle thereof. FIG. 3 is a simplified frontal view of the first illustrative embodiment of the kicker mechanism incorporating the teachings of the present invention.

As shown in FIGS. 1–3,in the first embodiment, the kicker mechanism 70 includes a kicker cam 72 mounted on a pick shaft 64 between the first and second pick tires 66 and 68 respectively. As illustrated in the side views of FIGS. 2*a*–2*d*, the kicker cam 72 has a crescent-like, semi-circular D-shape. The kicker cam 72 may be made of plastic or other suitable material. The cam 72 has a protrusion 73 at a first end of a can surface adapted to engage a kicker 76. The cam surface has a generally arcuate shape to a second end 74. As discussed more fully below, the arcuate shape of the cam surface facilitates an un-impeded return of the kicker 76 to its home position when the kicker cam 72 has rotated to a position at which the kicker 76 is no longer in contact therewith, i.e., at the second end of the cam surface 74.

In the illustrative implementation, the kicker 76 is a piece of plastic of a substantially planar construction. At the proximal end thereof, the kicker is generally U-shaped with upwardly extending portions 77 and 79 providing a trough 78 therebetween. The trough 78 is adapted to engage the kicker cam 72 during a portion of its rotational cycle. The upwardly extending portions 77 and 79 engage and reset media on the stack 32 as discussed more fully below. The kicker 76 is pivotally mounted to a frame, base or other rigid structure in the printer at a pivot point 75 and it is biased by a spring 80. One end of the spring 80 is connected to a distal end of the kicker 76 and the other end of the spring 80 is secured to the housing assembly 12.

A separator pad 82 moves up and down under the influence of a second spring 84 to ensure an adequate separation force is applied to the media as it is drawn off the stack 32 by the pick tires 66 and 68. (See FIG. 3). The stack 32 is also biased upward by a third spring 86.

FIG. 2*a* depicts the first embodiment of the inventive kicker mechanism 70 in a home position with the kicker 76 biased forward by a kicker spring 80. In operation, after the initiation of a pick cycle under the control of the microprocessor 130, the pick tires 66 and 68 and the kicker cam 72 begin to rotate.

FIG. 2*b* depicts the first embodiment of the inventive kicker mechanism 70 after initiation of a pick cycle. The kicker cam 72 has pushed the kicker 76 back to a second position to allow sheets of paper to make contact with the pick tires 66 and 68 (not shown in FIGS. 2*a*–2*d*.) The stack of paper 32 has been allowed to rise to meet the pick tires 66 and 68 under the influence of the spring 86 by a conventional stack height control cam mechanism (not shown) operating off of the shaft 64. The separator pad 82 has been pushed down by the pick tires 66 and 68. The periphery of the cam 72 maintains the kicker 76 in the second position. The pick tires have a coefficient of friction (e.g., ~1.6 with paper) effective to cause the paper to move as the tires rotate thereover as is well known in the art. The separator pad 82 has a coefficient of friction with paper of ~1.0 typically and thereby assists in the extraction of a single sheet from the stack 32.

FIG. 2*c* depicts the first embodiment of the inventive kicker mechanism 70 as the sheet of paper moves over the kicker 76 to be picked up by a feed roll. The pick tires 66 and 68 and the kicker cam 72 continue to rotate counter clockwise and the stack of paper 32 is lowered by the stack height control cam mechanism (not shown). The kicker 76 will remain pushed back by the cam 72 until the single sheet passes over it completely. After the single sheet has passed, the kicker cam 72 rotates past the point at which the end 74 is in contact with the kicker 76. The kicker 76, under load of the kicker spring 80, pushes any sheets of paper that remain on the separator pad 82 back onto the stack of paper 32.

FIG. 2*d* depicts the first embodiment of the inventive kicker mechanism 70 with all parts back in the home position with the exception of the kicker 76. The mechanism 70 is then in its initial state with the kicker cam 72 and the kicker 76 in the home position.

Figure 4:
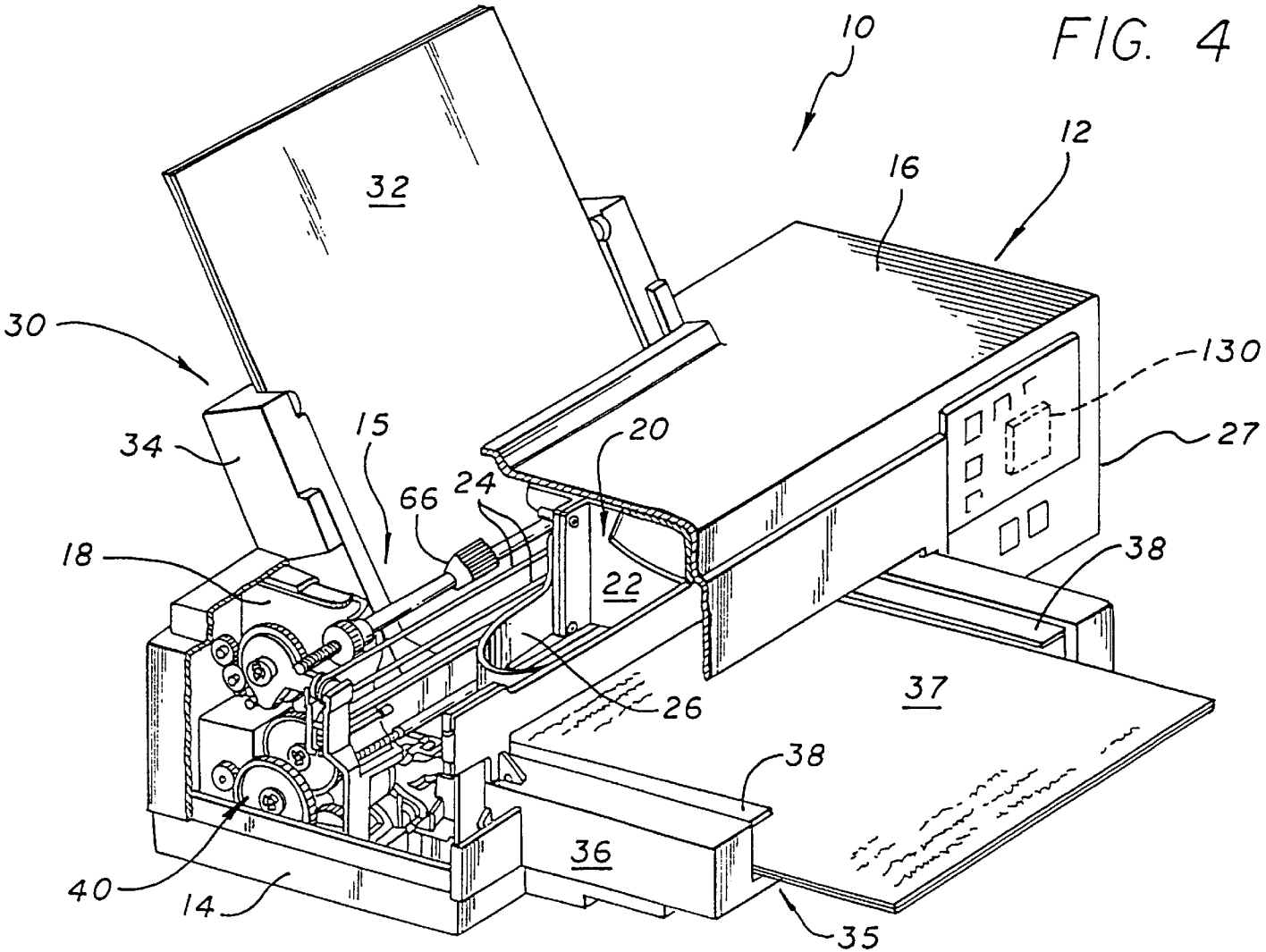
FIG. 4 is a perspective view of a printer incorporating the second illustrative embodiment of the sheet feeding mechanism of the present invention with the housing thereof partially removed.

While the embodiment of FIG. 2*a* is particularly well suited for horizontal stacks of media, the second embodiment of FIGS. 4 and 5 is designed for use with an inclined stack of media. The reason for inclining the stack 32 is to reduce the footprint of the printer 10. However, when the stack is inclined, many more sheets remain on the separator pad 82 due to the force of gravity. Unfortunately, it is difficult to engineer a kicker spring 80 that is strong enough to clear the sheets from the separator pad 82 without causing damage to same.

FIG. 4 is a perspective view of a printer incorporating the second illustrative embodiment of the sheet feeding mechanism of the present invention with the housing thereof partially removed. Note that the mechanism is essentially identical to that of FIG. 1 with the exception that the supply tray 34 is inclined relative to the housing assembly 12 and the kicker mechanism 70' differs from the kicker mechanism 70 of FIG. 1 as discussed more fully below.

FIGS. 5*a*–5*f* provide simplified side views of the second illustrative embodiment of the inventive kicker mechanism 70' in various stages of the operational cycle thereof. The second embodiment of the kicker is similar to the first with the difference being the extension of the second end 74' of the cam surface. Initially, the operation of the second embodiment of the kicker mechanism 70' is the same as that of the first embodiment 70 as illustrated in FIGS. 5*a*–5*d*. After a single sheet has passed over the kicker 76', the kicker cam 72' is counter-rotated as shown in FIG. 5*e* and the extended second end 74' of the cam 72' pushes back against the kicker 76' forcing it up against the stack 32. Finally, in FIG. 5*f*, the mechanism 70' is shown in the home position.

FIGS. 6*a*–6*d* provide simplified side views of the third illustrative embodiment of the inventive kicker mechanism 70" in various stages of the operational cycle thereof. FIG. 7 is a front view of the third illustrative embodiment of the inventive kicker mechanism 70". This design is a counter rotating roll design that uses staggered and nested rolls to achieve separation. The use of counter-rotating rolls in automatic sheet feeders is a fairly common concept. However, the chief problems with the use of counter-rotating rolls is that the force between the rolls is hard to maintain within a certain range and a torque limiter must be used if the torque at the motor is to be kept low for high speed operation. Also, kickers are not employed in these systems due to geometry constraints notwithstanding the potential for improved reliability associated with the use of same.

As shown in FIGS. 6*a*–6*d* and 7, the inventive third kicker mechanism 70" includes a separator roll 72" mounted between the first and second 'D' shaped pick tires 66 and 68. The separator roll 72" is made of plastic and has a coefficient of friction with paper of approximately 1.0. First and second flexible kickers 76" and 77" are positioned on a kicker shaft 65" with the separator roll 72" outside of the first and second pick tires 66 and 68 as depicted in phantom in the frontal view of FIG. 7. The flexible kickers 76" and 77" are made of mylar or other suitable material and are approximately 0.4 mm thick. Each kicker 76" and 77" is made long enough to effectively reset the stack 32 as discussed more fully below. The kicker is made to be flexible so that the stack of paper can be located under the pick tires.

Figure 6A:
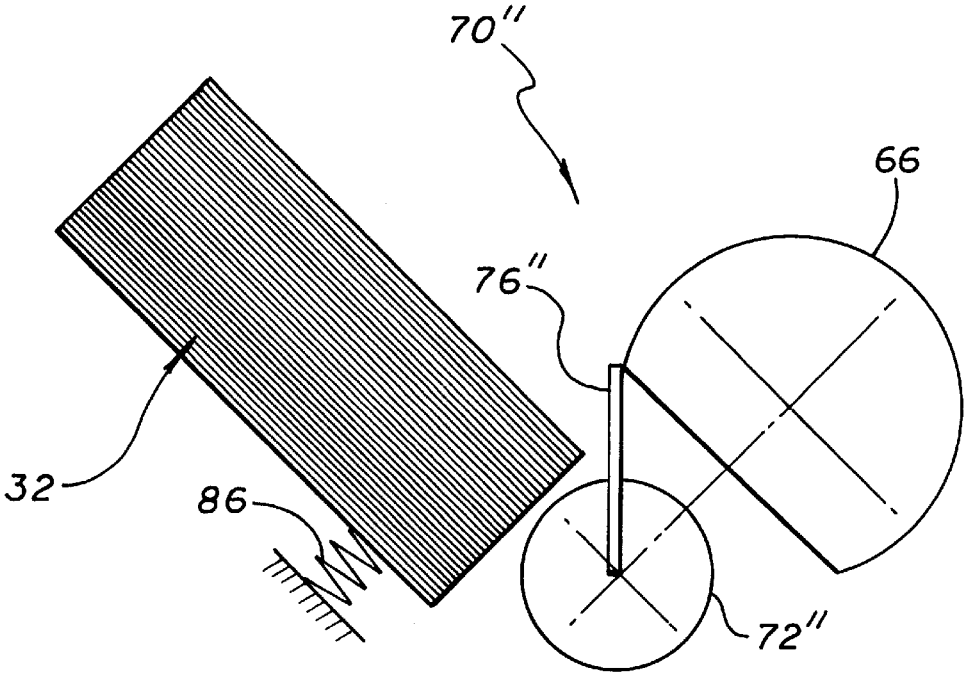
FIGS. 6*a*–6*d* provide simplified side views of the third illustrative embodiment of the inventive kicker mechanism in various stages of the operational cycle thereof.

The operation of the third embodiment is best illustrated with respect to FIGS. 6*a*–6*d*. FIG. 6*a* shows the mechanism 70" in its home position and initialized. The pick tires 66 and 68 and the separator roll 72" are rotated exactly one revolution per pick cycle. The paper stack is raised and presented to the pick tires at the beginning of the cycle and lowered before its completion.

Figure 6B:
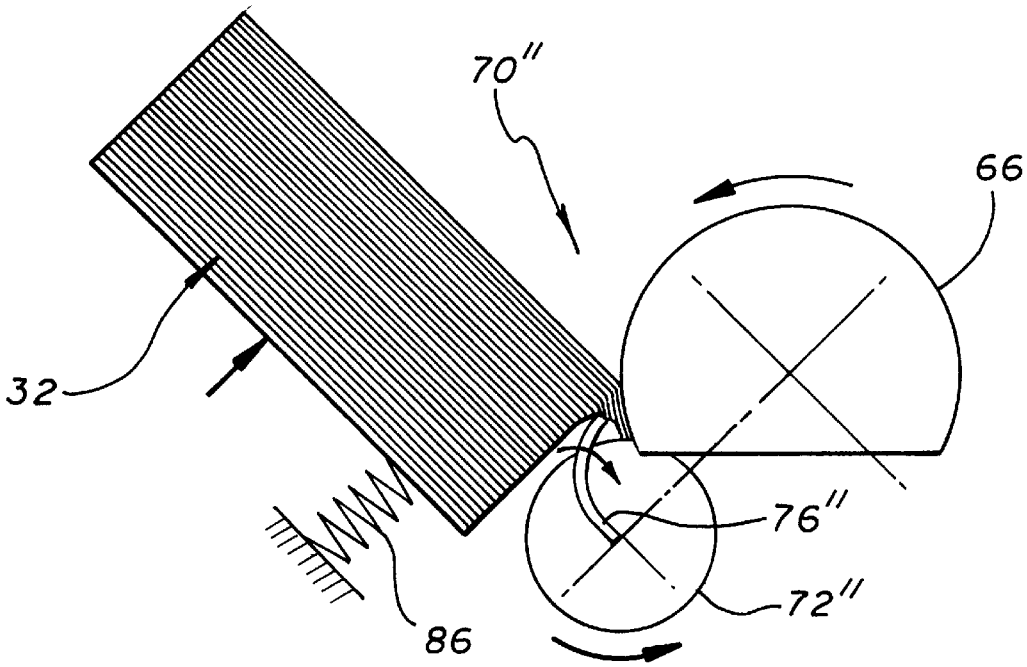
Figure 7:
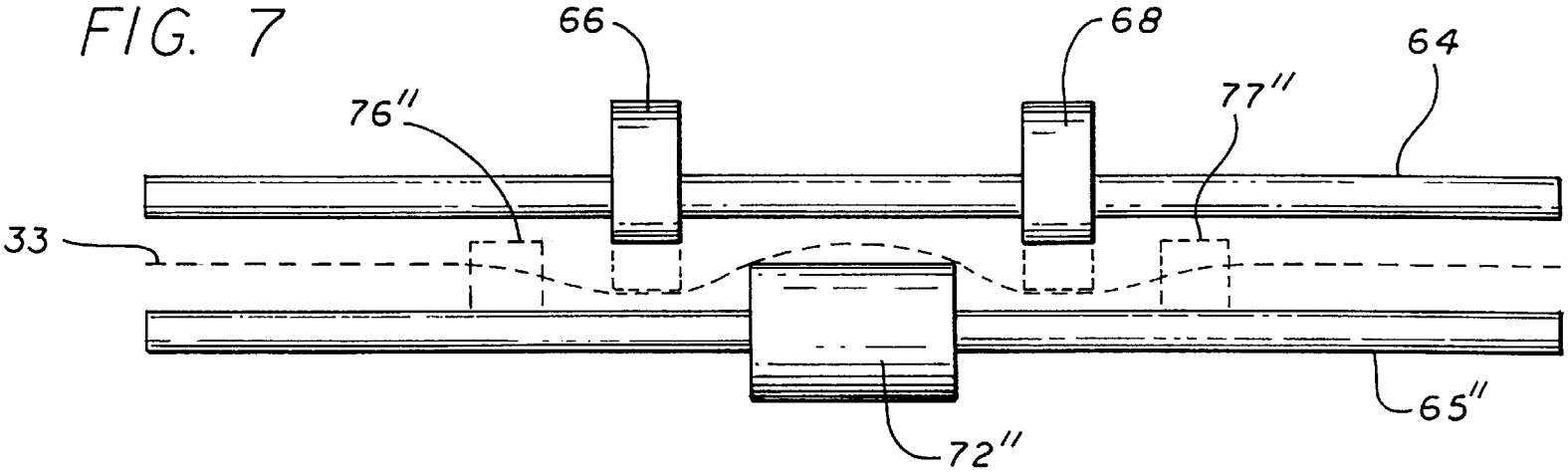
FIG. 7 is a front view of the third illustrative embodiment of the inventive kicker mechanism.

FIG. 6*b* shows the pick tires 66 and 68 rotating counter-clockwise and pulling the top few sheets from the raised stack into the separation zone. At the same time, the separator roll 72" is rotating counter-clockwise which keeps all but the top sheet 33 from getting past the kickers 76" and 77". This causes the flexible kickers 76" and 77" to bend down and out of the way.

Figure 6C:
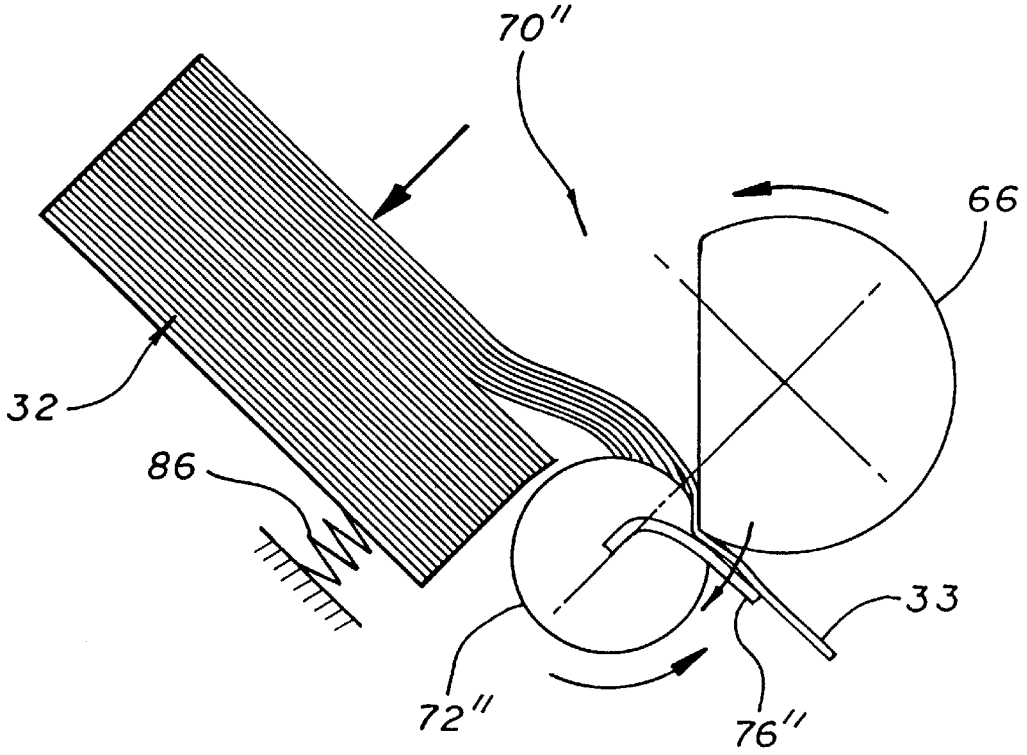

FIG. 6*c* shows the stack 32, which has been lowered and the pick tires 66 and 68 and the separator roll 72" continuing to rotate in the same direction. The flexible kickers 76" and 77" are gent back by the single sheet 33 as it passes thereover while the separator roll 72" continues to prevent the feeding of extra sheets.

Figure 6D:
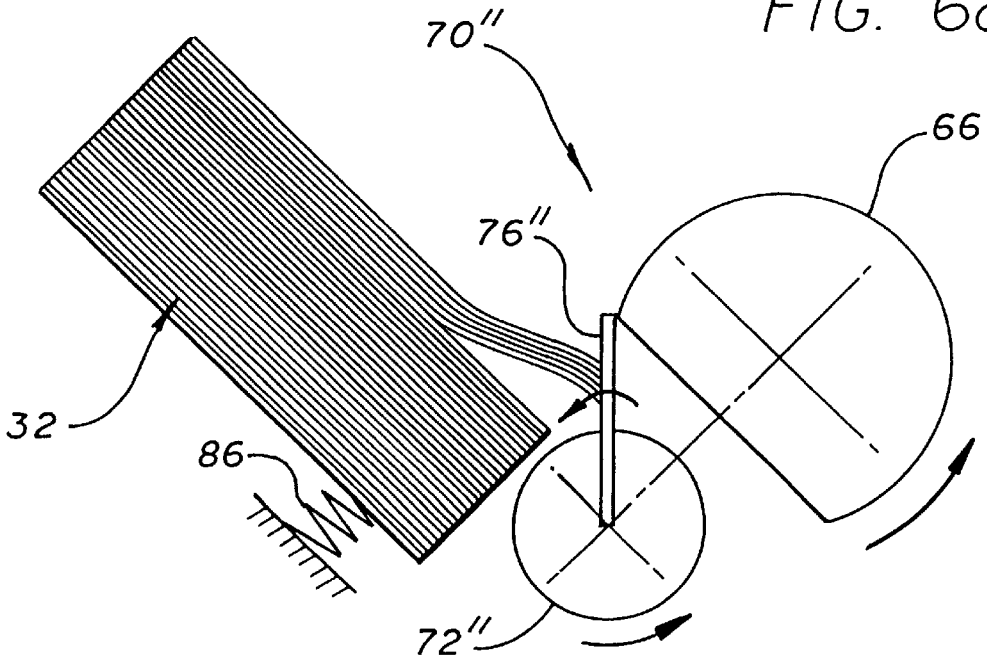

Finally, FIG. 6*d* shows all components back in the home position. The kickers 76" ad 77" once released by the single sheet straightens out and pushes excess sheets from the separation zone and back onto the stack and into an initialized position.

As shown in FIG. 7, the sheet of paper 33 is used as a separator spring as it bends around the rolls. This allows for the elimination of the expensive torque limiter and tight tolerances associated with the separator force. Also, because there is no torque limiter on the separating roll, a flexible kicker may be used to clear the separation zone. This allows the paper stack to be at an incline, which reduces the machine's footprint as mentioned above.

Figure 9:
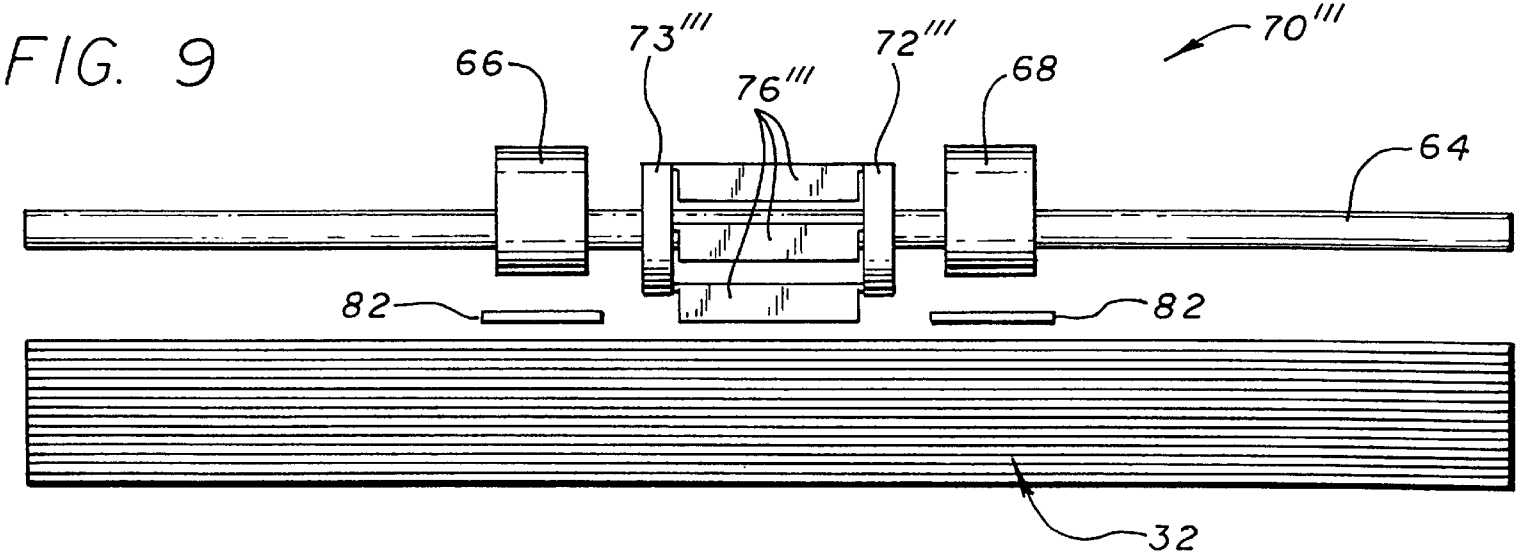
FIG. 9 is a front view of the fourth illustrative embodiment of the inventive kicker mechanism.

FIGS. 8*a*–8*f* show simplified side views of the fourth illustrative embodiment of the inventive kicker mechanism 70'" in various stages of the operational cycle thereof. FIG. 9 is a front view of the fourth illustrative embodiment of the inventive kicker mechanism 70'". As shown in FIGS. 8*a*–8*f* and 9, the inventive kicker mechanism 70'" includes first and second kicker tires 72'" and 73'" mounted on a pick shaft 64 between first and second pick tires 66 and 68. A plurality of plastic kicker elements 76'" are positioned between the first and second kicker tires 72'" and 73'". Each kicker element is a blade mounted for pivotal movement about a pin 81'" and is free to fall under the influence of gravity until it contacts a motion limiter 79'". The motion limiters 79'"are pegs, pins or bumps of plastic or metal positioned to limit the range of motion of the kicker 76'" as illustrated in FIGS. 8*a*–*f*.

Figure 8A:
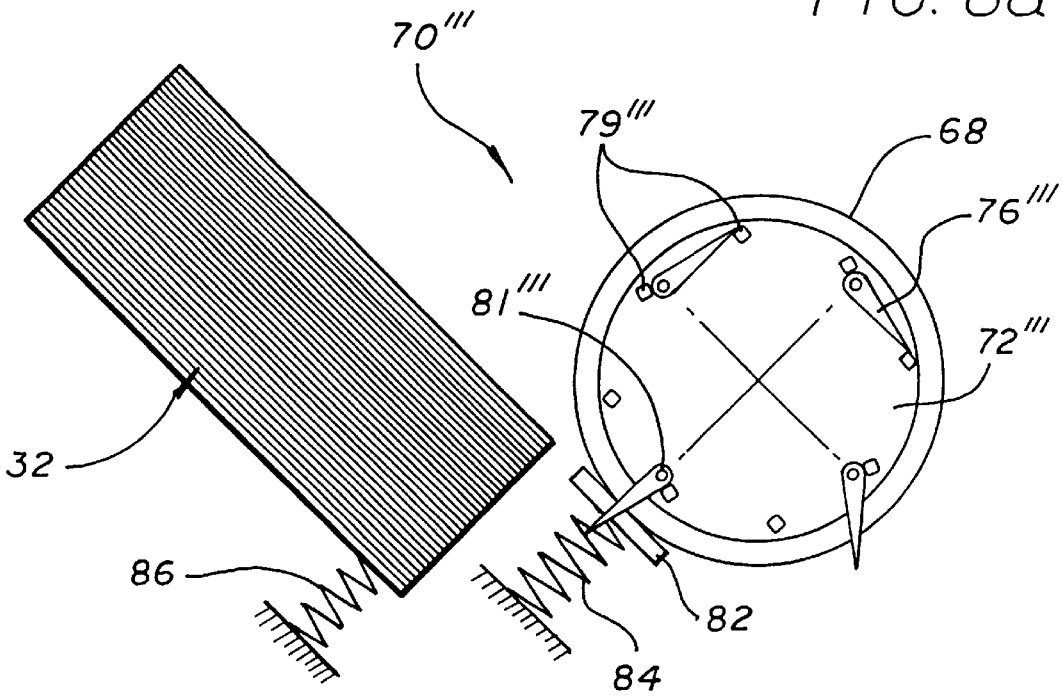
FIGS. 8*a*–8*f* show simplified side views of the fourth illustrative embodiment of the inventive kicker mechanism in various stages of the operational cycle thereof.

FIG. 8*a* shows the kicker mechanism 70'" in a starting position. There is no home position for this implementation. As the shaft 64 rotates, the kickers 76'" rotate off center and get pushed up and out of the way when the shaft 64 rotates counter-clockwise (as shown in FIGS. 8*a*–*d*) and drop down to push the paper when the shaft is rotating clockwise (as shown in FIGS. 8*a* and *f*). The separator pad 82 moves up and down to ensure an adequate separation force and is biased upward with a spring 84. The stack 32 is also biased upward but it is raised at the start of the pick cycle and lowered prior to its completion.

Figure 8B:
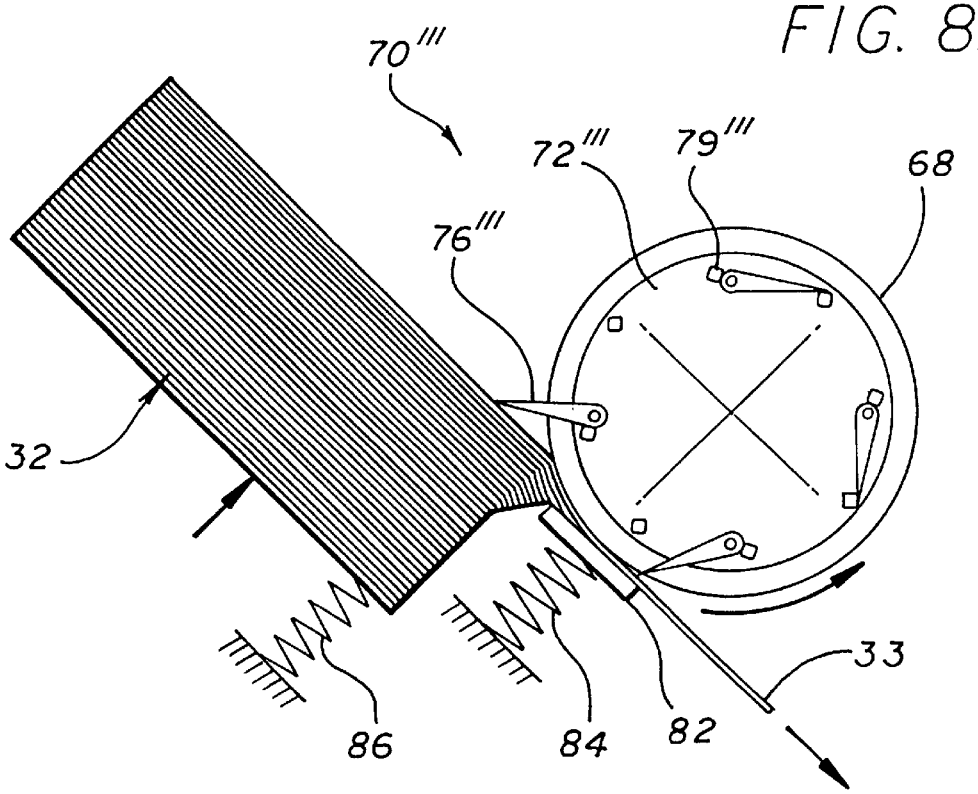

FIG. 8*b* shows the mechanism 70'" after starting the pick cycle. The sheets are pushing the kickers 76'" up and out of the way with the forward rotation. The stack of paper 32 has been allowed to rise to meet the pick tires 66 and 68 and the top few sheets have been drawn into the separation zone.

Figure 8C:
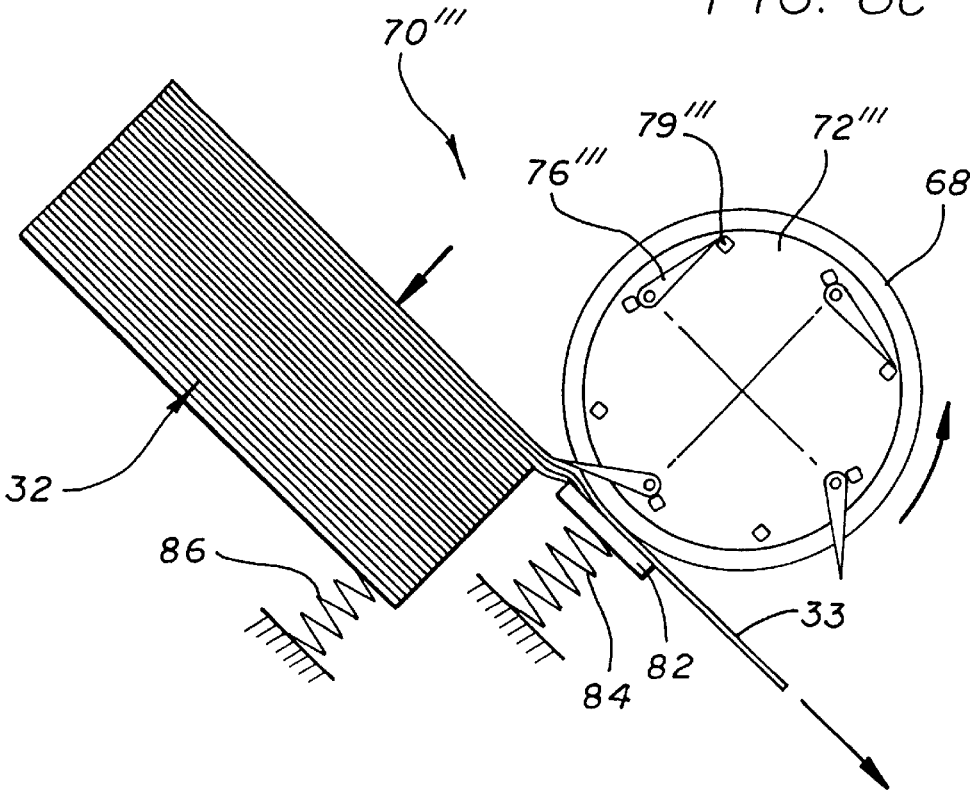

FIG. 8*c* shows the shaft 64 rotated forward even farther and helps to describe the motion of the kickers 76'".

Figure 8D:
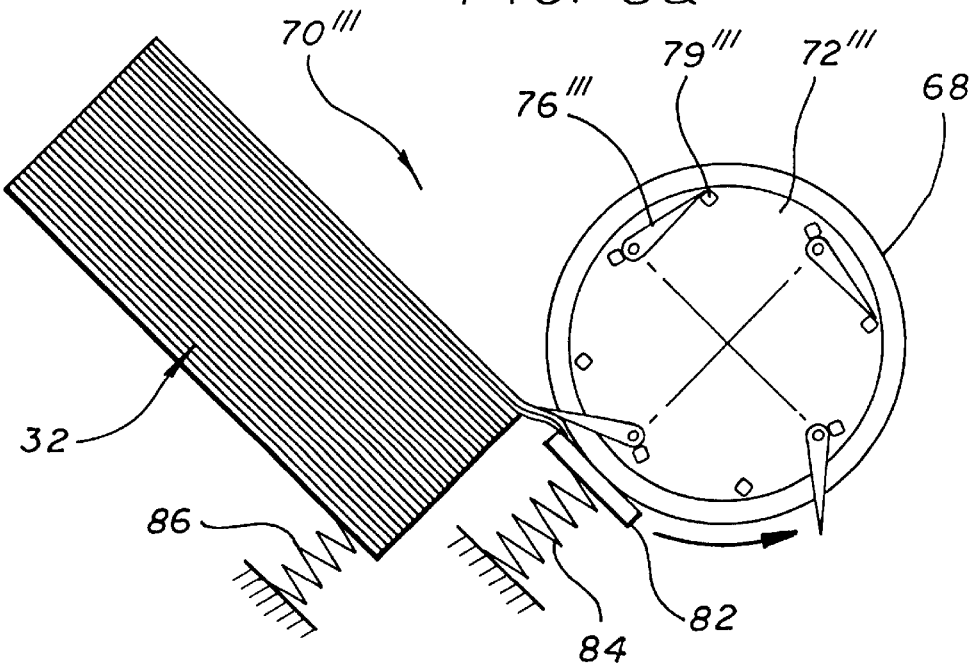

FIG. 8*d* shows the mechanism 70'" after the top sheet has been completely fed.

Figure 8E:
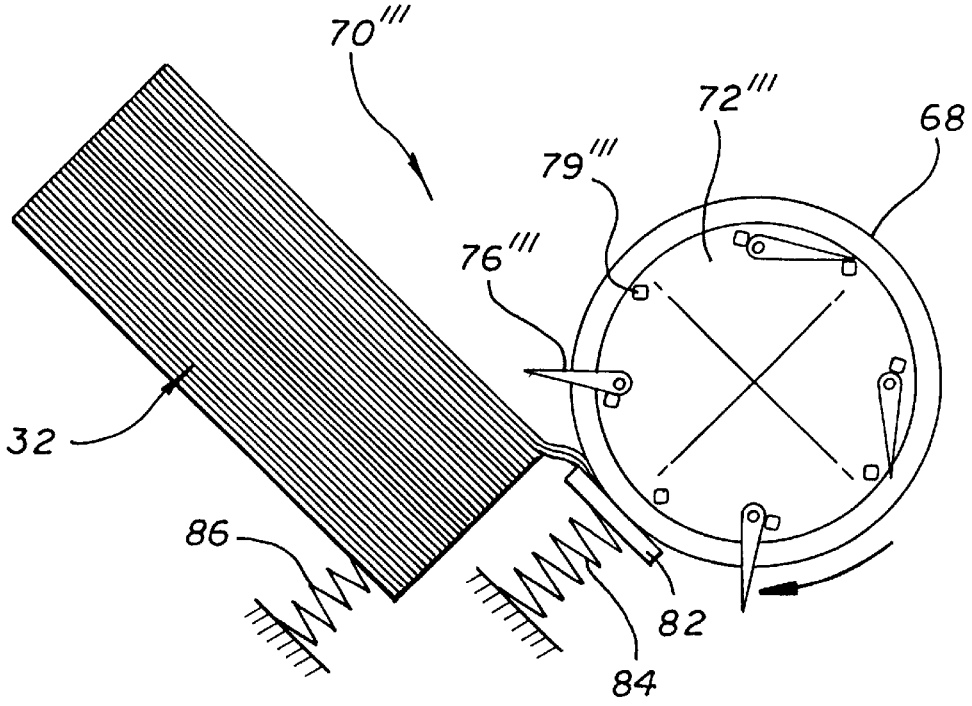

FIG. 8*e* shows the kicker tire 72'" reversing direction and the kickers 76'" dropping down to push the paper out of the separation zone.

Figure 8F:
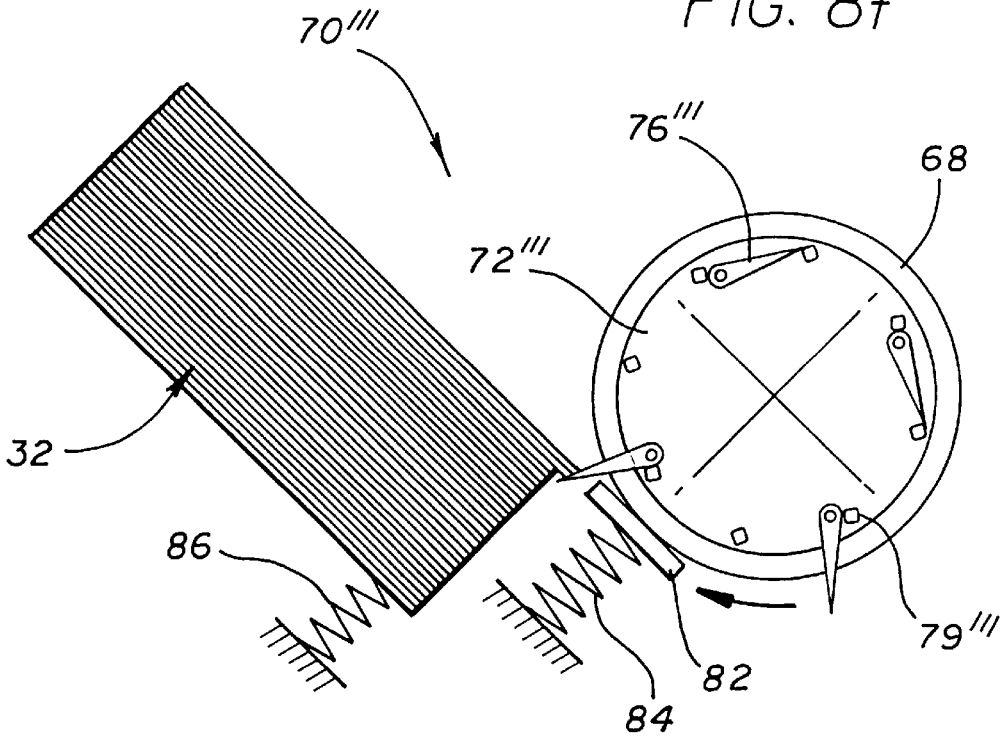

FIG. 8*f* shows the sheets being completely kicked out of the separation zone and onto the stack of sheets.

Thus, the present invention has been described herein with reference to a particular embodiment for a particular application. Those having ordinary skill in the art and access to the present teachings will recognize additional modifications applications and embodiments within the scope thereof. For example, the invention is not limited to the biasing arrangements shown herein. Those skilled in the art will appreciate that the kickers may be rigidly mounted (instead of pivotally mounted) with an inherent spring force in lieu of a biasing spring.

It is therefore intended by the appended claims to cover any and all such applications, modifications and embodiments within the scope of the present invention.

Accordingly,

What is claimed is:

1. An automatic sheet feeding mechanism comprising:

first and second pick tires mounted on a shaft for selectively moving a sheet of media from a stack; and kicker means mounted to said first and second pick tires for retaining media on said stack in a first position, said kicker means including plural blades pivotally mounted to first and second kicker tires and mounted therebetween for rotational movement from said first position to a second position in response to gravity.

2. The invention of claim 1 further including means for counter rotating said first and second pick tires thereby causing said blades of said kicker means to pivot to said first position and thereby push media onto said stack.

3. The invention of claim 1 further including limiting means for limiting the motion of said blade means.

4. A method for sheet feeding including the steps of:

selectively moving a sheet of media from a stack with first and second pick tires and retaining media on said stack with a kicker in a first position coupled to said first means, said kicker including plural blades pivotally mounted to first and second kicker tires and mounted therebetween for rotational movement from said first position to a second position in response to gravity.

* * * * *